US008556753B1

(12) United States Patent
Dixon, Jr.

(10) Patent No.: US 8,556,753 B1
(45) Date of Patent: Oct. 15, 2013

(54) BATTING TRAINING SYSTEM AND THE COMPONENTS THEREOF

(76) Inventor: Nicholas E. Dixon, Jr., Albertville, AL (US)

( * ) Notice: Subject to any disclaimer, the term of this patent is extended or adjusted under 35 U.S.C. 154(b) by 152 days.

(21) Appl. No.: 13/068,765

(22) Filed: May 19, 2011

Related U.S. Application Data

(60) Provisional application No. 61/455,515, filed on Oct. 21, 2010.

(51) Int. Cl.
*A63B 69/00* (2006.01)

(52) U.S. Cl.
USPC ..... 473/417; 473/422

(58) Field of Classification Search
USPC ..... 473/417, 451, 418–420, 422; D21/715, D21/780
See application file for complete search history.

(56) References Cited

U.S. PATENT DOCUMENTS

| | | | | | |
|---|---|---|---|---|---|
| 2,985,452 | A | * | 5/1961 | Trippet | 473/453 |
| 3,876,203 | A | | 4/1975 | Gold | |
| 3,940,131 | A | * | 2/1976 | St. Claire, Jr. | 473/417 |
| 4,516,771 | A | * | 5/1985 | Nau | 473/453 |
| 4,886,267 | A | | 12/1989 | Licciardi et al. | |
| 4,979,741 | A | * | 12/1990 | Butcher | 473/417 |
| 5,029,852 | A | | 7/1991 | Gilfillan | |
| 5,087,039 | A | | 2/1992 | Laseke | |
| 5,322,276 | A | | 6/1994 | Hardison, Jr. | |
| 5,435,545 | A | | 7/1995 | Marotta | |
| 5,478,070 | A | * | 12/1995 | Morrison | 473/419 |
| 5,642,880 | A | | 7/1997 | Wiseman et al. | |
| D403,730 | S | * | 1/1999 | Balestrieri | D21/780 |
| 5,928,092 | A | | 7/1999 | Keeter et al. | |
| 6,413,175 | B1 | | 7/2002 | Mooney, Jr. | |
| 6,666,781 | B1 | * | 12/2003 | Illis | 473/453 |
| 7,303,494 | B1 | * | 12/2007 | Daniels | 473/417 |
| 7,517,290 | B1 | * | 4/2009 | Springer | 473/422 |
| 7,601,081 | B1 | * | 10/2009 | Larkey | 473/454 |
| 7,967,704 | B2 | * | 6/2011 | Schulte | 473/417 |
| 8,147,355 | B2 | * | 4/2012 | Burgess | 473/417 |
| 2005/0266936 | A1 | * | 12/2005 | Gutierrez | 473/417 |
| 2008/0085787 | A1 | * | 4/2008 | Molloy et al. | 473/417 |
| 2008/0132362 | A1 | * | 6/2008 | Brazzano | 473/452 |
| 2011/0077109 | A1 | * | 3/2011 | Crowley | 473/453 |
| 2012/0264547 | A1 | * | 10/2012 | Windsor | 473/417 |

OTHER PUBLICATIONS

Author unknown, Introducing the New H.I.T., Hands Inside Trainer, date unknown, one page, www.hittingworld.com.

Author unknown, Hands Inside Trainer—A New Hitting Tool From the Makers of the Insider Bat, Hands Inside Trainer, date unknown, five pages, www.my-youth-baseball.com.

* cited by examiner

*Primary Examiner* — Mitra Aryanpour
(74) *Attorney, Agent, or Firm* — John R. Flanagan

(57) ABSTRACT

A batting training system is adapted for use with standard variety of conventional baseball and softball batting tees to expand their capabilities by enabling hitters using them to receive an advanced level of training in how to properly swing a bat to effectively hit a ball. The batting training system includes a swing plane guide, a swing barrier guide and/or a swing instructional training guide which serve most effectively as training tools when used in conjunction with one another. However, they also may be used in different paired combinations or individually as training tools. The system also includes a resiliently deformable interface in the form of an insert wedge which enables the swing plane guide or the swing barrier guide to be attached to batting tee columns of different diameters.

19 Claims, 10 Drawing Sheets

BATTING TRAINING SYSTEM AND THE COMPONENTS THEREOF

This patent application claims the benefit of U.S. provisional application No. 61/455,515 filed Oct. 21, 2010. The disclosure of said provisional application is hereby incorporated herein by reference thereto.

BACKGROUND OF THE INVENTION

1. Field of the Invention

The present invention generally relates to batting practice equipment and, more particularly, is concerned with a batting training system which includes a swing plane guide, a swing barrier guide and a swing instructional training guide.

2. Description of the Prior Art

Batting tees are widely used to practice hitting a ball, such as a baseball or softball. Learning ball hitting skills is a process that requires repetitive practice. It is important that the practice repetition is done correctly. Ball hitting skills depends on making a proper swing with the bat. A proper swing must be made through a proper angle as the bat approaches the ball. The proper angle is one that is at least level or parallel with the ground, and preferably one that has a downward shallow slope toward the ground, in the direction of the swing. The proper swing also must have a short compact and quick approach of the bat to the ball. A swing that is too long or that follows an "upper cut" path is considered flawed. Therefore, it is extremely important that the batter know what a proper swing is and how to execute it.

Thus, for batting practice using a conventional batting tee to be beneficial for the player, the player must be trained in how to properly swing the bat to effectively hit the ball supported by the tee. The player must learn to replicate the same correct sequence of arm and body movements during each swing of the bat. Proper instruction is crucial to learning batting, or hitting, skills. Coaches can instruct and teach, but it is difficult for the coach or instructor to see, observe, or critique every player's practice swing. This is especially the case with a team of players practicing at the same time. The coach has a difficult task to make sure every practice swing is done correctly.

Various bat swing training and guide devices have been introduced with the objective in mind of facilitating the training of a player in how to execute a proper swing. Some of these devices incorporate a modified batting tee. Others are separate from but are used with a conventional batting tee. However, most of these devices are bulky, complicated, and expensive. Thus, innovation is needed to make these types of devices more effective and affordable for users.

SUMMARY OF THE INVENTION

The present invention is directed to a batting training system which satisfies the aforementioned need. The system of the present invention is adapted for use with conventional baseball and softball batting tees to improve swing practice quality and instruction. The system can be used to help experienced players perfect their batting skills and inexperienced players learn proper swing mechanics. The components of the system, which may be used most effectively but not exclusively in conjunction with one another, include a swing plane guide, a swing barrier guide and a swing instructional training guide. The system can help a batter know exactly where to place the swing plane guide and his or her feet in relation to each strike pitch location (inside, middle and away) during hitting practice, improve bat speed, develop the highly acclaimed "top half" hitting technique, and learn to "hit the ball where it's pitched".

Accordingly, the present invention is directed to a batting training system which includes a swing plane guide having a clip-on portion and a guide portion. The clip-on portion has an opening adapted to receive an upper end portion of a column of a batting tee. The clip-on portion is adapted to attach to the upper end portion of the batting tee column when received through the opening so as to position the clip-on portion adjacent to and below a ball holder element on the upper end portion of the batting tee column. The guide portion is connected to the clip-on portion and extends away therefrom. The guide portion has a top side adapted to extend away from the ball holder element such that, when the clip-on portion is attached to the upper end portion of the batting tee column, the top side defines a guide for a hitter to follow for training to swing a bat through a swing plane running substantially parallel to the top side of the guide portion to enable the hitter to make desired contact of the bat with the ball on the ball holder element.

Additionally, the batting training system can include a swing barrier guide having a clip-on portion and a barrier portion. The clip-on portion has an opening adapted to receive the upper end portion of the batting tee column. The clip-on portion is adapted to attach to the upper end portion of the batting tee column when received through the opening so as to position the clip-on portion below the ball holder element on the upper end portion of the batting tee column and adjacent to and below the clip-on portion of the swing plane guide. The barrier portion is connected to the clip-on portion and extends therefrom away therefrom. The barrier portion has an outwardly-extending first arm connected at an inner end to the clip-on portion and an upwardly-extending second arm connected at a lower end to an outer end of the first arm such that, when the clip-on portion is attached to the upper end portion of the batting tee column, the barrier portion provides another guide for the hitter to follow for training to swing the bat between the hitter and a barrier element, defined by the second arm of the barrier portion, without contacting the barrier element.

Further, the batting training system can include a swing instructional training guide having a matt with a top surface, a series of indicators applied on the top surface of the matt, and a series of markers connected to the matt and adapted to be adjustably moved relative to the matt. The matt also has an opening through it adapting the matt to be installed over the batting tee column with the column extending through the matt and the matt overlying a base of the batting tee. The indicators on the matt represent middle, inside and away strike pitches relative to the batting tee column to show at what angle to locate the swing plane guide on the batting tee column relative to the strike zone of the hitter so as to identify for the hitter the correct path along which the hitter should swing the bat for approaching the ball to enable the hitter to make desired contact of the bat with the ball when the ball represents a pitch at one of the middle, inside or away strike locations. The markers have distinguishing markings on upper surfaces thereof to guide adjustment of the markers to different locations for feet placement by the hitter relative to the pitch location indicators.

Still further, the batting training system can include a deformable interface in the form of an insert wedge of resiliently flexible compressible material. A different one of the interfaces may be used with each of the swing plane and barrier guides to enable them to be attached to batting tee columns of different diameters.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
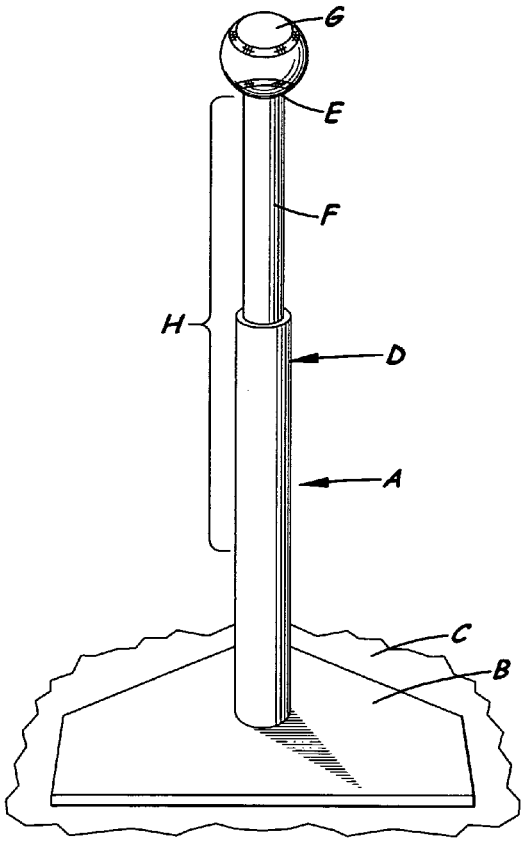
Fig. 1 (PRIOR ART)
FIG. 1 is a prior art perspective view of one of a standard variety of batting tees.
Figure 2:
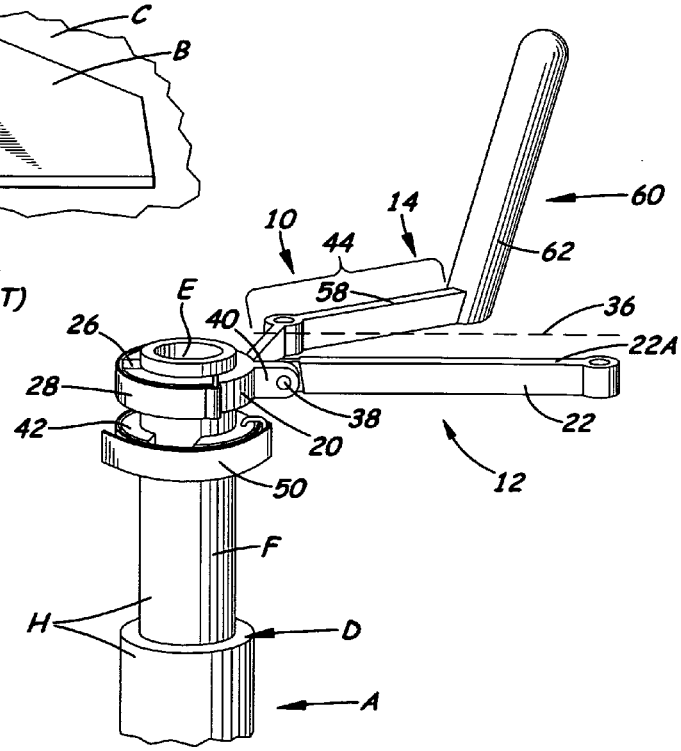
FIG. 2 is a perspective view of an exemplary embodiment of a swing plane guide and a swing barrier guide of a batting training system in accordance with the present invention, shown assembled to an upper end portion of a column of a batting tee.
Figure 4:
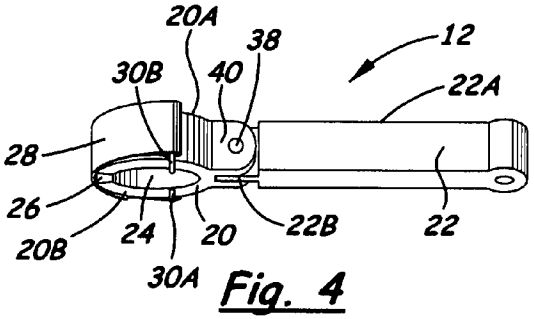
FIG. 4 is a side perspective view of the swing plane guide of FIG. 3.

Referring to the drawings, and particularly to FIG. 1, there is illustrated one of a standard variety of batting tees, generally designated A. The batting tee A may include a support base B, adapted to rest on a support surface C, for example any outside or inside playing surface, and a column D standing upright and securely mounted on the support base B. The column D has a ball holder element E on its upper end portion F adapted to support a ball G. The column D typically may have multiple tubular shafts H disposed in a telescoping relationship with one another. The multiple tubular shafts H have different diameters dimensioned so that they snugly fit one into the next and can be vertically adjusted relative to one another. Such adjustability allows the uppermost shaft or upper end portion F that has the ball holder element E to be vertically adjusted to position the ball G at a given height above the support base B selected for a player of a known height.

Referring now to FIGS. 2-17, there is shown an exemplary embodiment of components of a batting training system, generally designated 10, in accordance with the present invention. The system 10 may include a swing plane guide 12 shown in FIGS. 2-5, a swing barrier guide 14 shown in FIGS. 2, 3 and 6-8, and/or a swing instructional training guide 16 shown in FIGS. 9-12. The system 10 may also includes a deformable interface 18 shown in FIGS. 3 and 13-17 in the form of an insert wedge of resiliently flexible compressible material. A different one of the interfaces 18 may be used with each of the swing plane guide 12 and swing barrier guide 14 to enable them to be attached to batting tee columns D of different diameters.

The system 10 can be used with a wide variety of conventional baseball and softball batting tees A to improve swing practice quality and instruction. The system 10 can be used to help experienced players perfect their batting skills and inexperienced players learn proper swing mechanics. The swing plane guide 12, swing barrier guide 14 and swing instructional training guide 16 serve most effectively as training tools when used in conjunction with one another. However, they also may be used in different paired combinations or individually as training tools. The system 10 enables owners of existing batting tees A to expand the capabilities of their batting tees by enabling players using them to receive an advanced level of training in how to properly swing the bat to effectively hit the ball G. The system 10 can be used to train a batter to develop a compact swing, improved bat speed, the ability to keep the "hands inside the ball", and the highly desired "top half" hitting technique, and to learn to hit the ball where it's pitched.

More particularly, referring to FIGS. 2-5, the swing plane guide 12 includes a clip-on portion 20 and a guide portion 22. The swing plane guide 12 can be made of a suitable semi-flexible material, such as rubber, plastic, metal, or combination thereof, using known fabrication techniques, such as molding, well-known to those skilled in the art. The clip-on portion 20 of the guide 12 takes the form of a C-shaped body having a central opening 24 and a side slot 26 merging with the opening 24 and extending lengthwise between opposite ends 20A, 20B of the clip-on portion 20. The slot 26 and flexibility of the clip-on portion 20 adapts it to receive and attach, such as by way of a grip or clamp action, to the upper end portion F of the batting tee column D, adjacent to and below the ball holder element E, with the upper end portion F of the batting tee column D extending through the opening 24 and from the opposite ends 20A, 20B of the clip-on portion 20. The clip-on portion 20 and the column D are sufficiently flexible to permit the upper end portion F to be forced through the slot 26 into the opening 24. Alternatively, the upper end portion F (or uppermost shaft) of the batting tee column D can be removed from the rest of the column shafts H, the clip-on portion 20 then inserted at the lower end of the upper end portion F, moved upward to adjacent the ball holder element E, and then the upper end portion F reinserted onto the rest of the column shafts H.

The clip-on portion 20 also has a flexible strap 28 anchored at one end to a first buckle 30A affixed on the clip-on portion 20 at one side of the slot 26. The flexible strap 28 can be inserted through a second buckle 30B affixed on the clip-on portion 20 at the opposite side of the slot 26. The strap 28 has fastening elements 32, 34 thereon, such as patches of hook and loop type fasteners, such that the strap 28 after being inserted through the second buckle 30B and folded, or doubled, back upon itself can be securely attached to itself by the well-known kind of cooperation between the hook and loop type of fastening elements 32, 34. The fastened strap 28 will augment the grip applied by the clip-on portion 20 on the upper end portion F of the batting tee column D. In such way, the clip-on portion 20 can be securely positioned adjacent to and below the ball holder element E on the upper end portion F of the batting tee column D.

Figure 5:
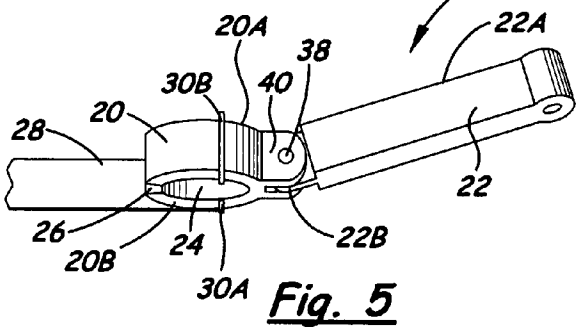
FIG. 5 is a side perspective view of the swing plane guide showing its guide portion pivoted to a different angular position relative to that shown in FIG. 4.

The guide portion 22 of the guide 12 takes the form of a generally straight beam connected to and extending in cantilevered manner away from a side of the body of the clip-on portion 20. The guide portion 22 has a top side 22A adapted to extend away from the ball holder element E such that, when the clip-on portion 20 is attached to the upper end portion F of the batting tee column D, the top side 22A provides a guide for a hitter to follow for training to swing a bat through a swing plane, as represented by dashed line 36, running substantially parallel to the top side 22A of the guide portion 22 to enable the hitter to make desired contact of the bat with the ball G on the ball holder element E. The guide portion 22 may be rigidly connected to the clip-on portion 20. Alternatively, the guide portion 22 may be pivotally connected to the clip-on portion 20 by a threaded "hinge" fastener 38 installed through aligned holes (not shown) formed in a clevis 40 affixed on and extending from a side of the clip-on portion 20 opposite the slot 26 and an end 22B of the guide portion 22 fitted within the clevis 40. The fit is sufficiently snug or tight and the fastener may be tightened to hold or retain the guide portion 22 at whatever position it is pivoted to relative to the clip-on portion 20. The hinged or pivotal connection thus allows angular adjustment of the top side 22A of the guide portion 22 in order to adjust the angular position of the guide for training the hitter in swinging the bat along the desired swing plane. In view of the foregoing, it is readily understood that the swing plane guide 12 can be used advantageously to correct and prevent two common swing flaws: the uppercut and dipping on the back side. An uppercut swing is not a desirable swing plane because the batter will hit the ball in the air and fly balls are more easily caught for outs. The most desirable swing plane is a level plane that produces a line drive swing that is known to produce more base hits. It can also be set as shown in FIG. 5 to teach the batter to use a downward swing angle. The downward swing plane is also desirable because it produces a ground ball which gives the batter a better chance of getting onto base. The batting tee column D can be rotated to enable the swing plane guide 12 to guide the batter to the proper bat direction of approach for hitting each of three directions, inside, away and middle contact locations.

Turning now to FIGS. 2, 3 and 6-8, the swing barrier guide 14 has a clip-on portion 42 and a barrier portion 44. The swing barrier guide 14 can be made of a suitable semi-flexible material, such as rubber, plastic, metal, or combination thereof, using known fabrication techniques, such as molding, well-known to those skilled in the art. The clip-on portion 42 takes the form of a C-shaped body having a central opening 46 and a side slot 48 merging with the opening 46 and extending lengthwise between opposite ends 42A, 42B of the clip-on portion 42. The slot 48 and flexibility of the clip-on portion 42 adapts it to receive and attach, such as by way of a grip or clamp action, to the upper end portion F of the batting tee column D, adjacent to and below the clip-on portion 20 of the swing plane guide 12, with the upper end portion F extending through the opening 46 and from the opposite ends 42A, 42B of the clip-on portion 42. The clip-on portion 42 and column D are sufficiently flexible to permit the upper end portion F to be forced through the slot 48 into the opening 46. Alternatively, the upper end portion F (or uppermost shaft) of the batting tee column D can be removed from the rest of the column shafts H, the clip-on portion 42 then inserted at the lower end of the upper end portion F, moved upward to adjacent the ball holder element E, and then the upper end portion F reinserted onto the rest of the column shafts H.

The clip-on portion 42 also has a flexible strap 50 anchored at one end to a first buckle 52A affixed on the clip-on portion 42 at one side of the slot 48. The flexible strap 50 can be inserted through a second buckle 52B affixed on the clip-on portion 42 at the opposite side of the slot 48. The strap 50 has fastening elements 54, 56 thereon, such as patches of hook and loop type fasteners, such that the strap 50 after being inserted through the second buckle 52B and folded, or doubled, back upon itself can be securely attached to itself by the well-known kind of cooperation between the hook and loop type of fastening elements 54, 56. The fastened strap 50 will augment the grip action applied by the clip-on portion 42 on the upper end portion F of the batting tee column D. In such way, the clip-on portion 42 can be securely positioned adjacent to and below the clip-on portion 42 of the swing plane guide 12 and below the ball holder element E on the upper end portion F of the batting tee column D.

The barrier portion 44 of the guide 14 takes the form of a rod structure connected to and extending away in a cantilevered manner from a side of the body of the clip-on portion 42. The barrier portion 44 has an outwardly-extending first arm 58 connected at an inner end to the clip-on portion 42 and an upwardly-extending second arm 60 connected at a lower end to an outer end of the first arm 58. When the clip-on portion 42 is attached to the upper end portion F of the batting tee column D, the barrier portion 44 provides another guide for the hitter to follow for training to swing the bat between the hitter and a barrier element 62, defined on the second arm 60 of the barrier portion 44, without contacting the barrier element 62. The first arm 58 of the barrier portion 44 has inner and outer arm portions 58A, 58B connected by a hinge 58C enabling pivotal movement of the outer arm portion 58B relative to the inner arm portion 58A to adjust the location of the second arm 60 and the barrier element 62 thereon relative to the swing plane guide 12. The second arm 60 may include a stem 64 and an elongated member made of a foam material being removably mounted on the stem 64 that forms the barrier element 62. In view of the foregoing, it is readily understood that the swing barrier guide 12 can be used advantageously to correct or prevent several common hitting flaws such as casting, looping, and being too long to the ball. The swing barrier teaches and guides the batter to have a short quick swing to the ball. The outside barrier forces the batter to rotate the hips and torso and extend the hands only at the point of contact, which produces a "quick" bat and more power too. Changing the angle of the barrier portion allows the barrier element to be moved closer to or away from the desired location to match the size of the batter or bat length.

Figure 9:
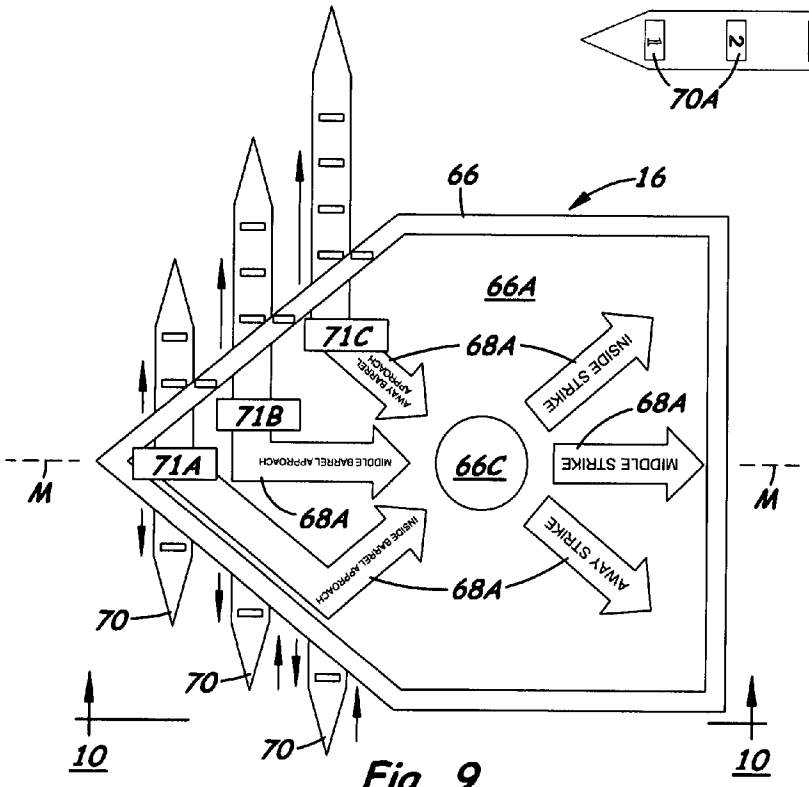
FIG. 9 is a top plan view of a swing instructional training guide of the batting training system of FIG. 3 shown oriented for use by a right-hand batter.
Figure 10:
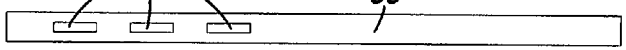
FIG. 10 is a side elevational view of a matt of the swing instructional training guide as seen along line 9-9 of FIG. 9.

Referring to FIGS. 9-12, the swing instructional training guide 16 includes a matt 66 with opposite surfaces 66A, 66B, a series of indicators 68A, 68B applied on the respective opposite surfaces 66A, 66B, and a series of markers 70 connected to the matt 66 and adapted to be adjustably moved relative to the matt 66. The matt 66 also has an opening 66C through it adapting the matt 66 to be installed over the batting tee column D with the column D extending through the matt 66 and the matt 66 overlying the support base B of the batting tee A. FIG. 9 shows the matt 66 oriented for use by a right-hand batter. FIG. 10 shows the matt 66 after being flipping or turned over (rotated 180° about a longitudinal axis M) to orient the guide 16 for use by a left-hand batter. The indicators 68A, 68B on the matt 66 represent middle, inside and away strike pitches relative to the batting tee column D to show at what angle to locate the swing plane guide 12 on the batting tee column D relative to the strike zone of the hitter so as to identify for the hitter the correct path along which the hitter should swing the bat for approaching the ball G to enable the hitter to make desired contact of the bat with the ball G when the pitch is at one of the middle, inside or away strike locations. The markers 70 are slidably mounted in edge slots 66D through the matt 66 have distinguishing markings 70A, such as numbers, colors, etc., on the opposite surfaces 70B thereof to guide adjustment of the markers 70 to different locations for feet placement by the hitter relative to the pitch location indicators 68A, 68B. The markings 70A enable the batter to set the unit to his or her regular setting before each workout. The guide 16 also has boxes 71A, 71B and 71C on the both opposite surfaces 66A, 66B which contain written instructions (not shown) to guide a batter concerning proper feet positions for the various strike locations. The instruction in Inside Strike box 71A say: Front Foot Zone—Move Foot Closer To Plate—Use Slide Out Marker. The instruction in Middle Strike box 71B says: Back Foot Zone—Move Foot Closer To Plate—Use Slide Out Marker. The instruction in Away Strike box 71C says: Back Foot Zone Move Foot Away From Plate—Use Slide Out Marker.

Figure 3:
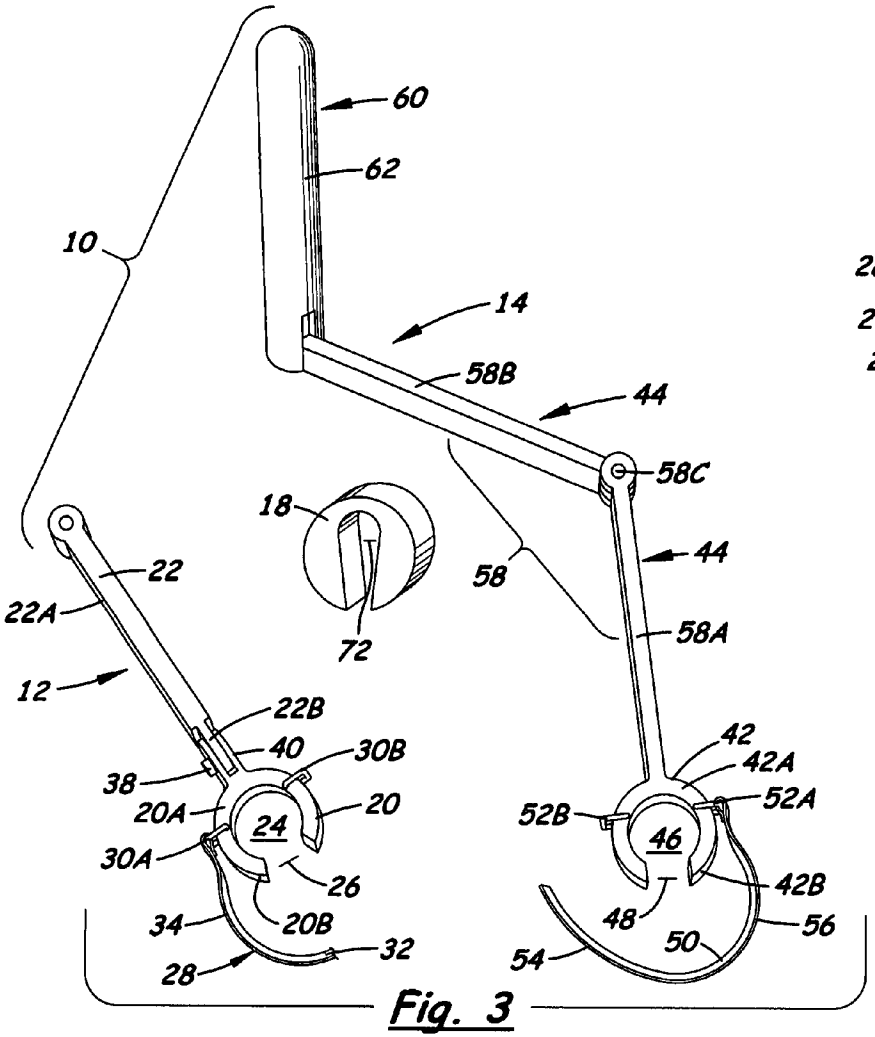
FIG. 3 is a top perspective view of the swing plane guide, the swing barrier guide and an insert wedge of the batting training system of FIG. 2 shown in disassembled form.
Figure 8:
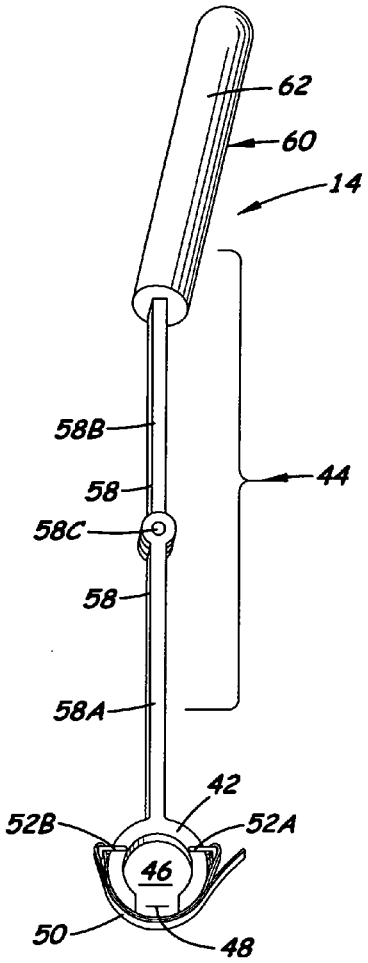
FIG. 8 is a top perspective view of the swing barrier guide of FIG. 6.
Figure 7:
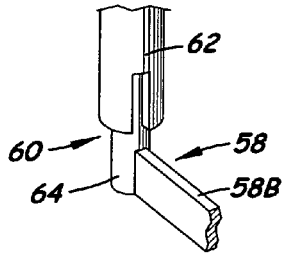
FIG. 7 is a fragmentary perspective view of a barrier element on a barrier portion of the swing barrier guide of FIG. 6.
Figure 6:
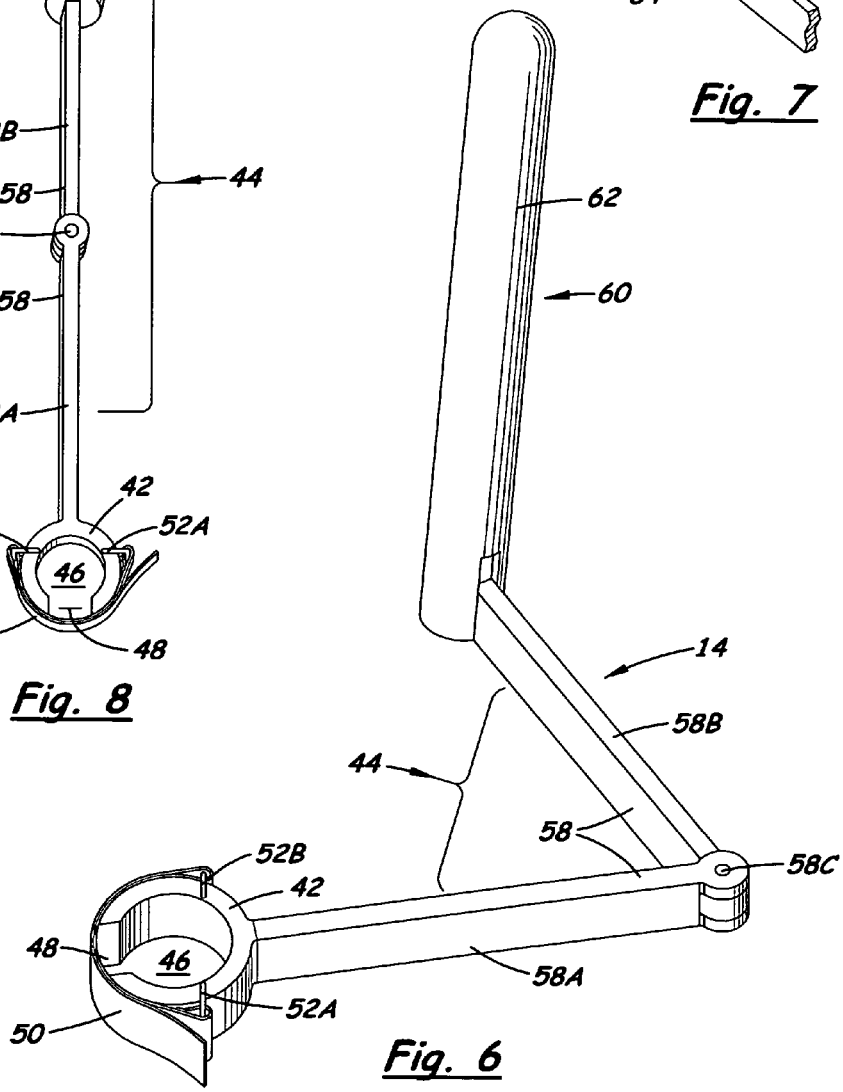
FIG. 6 is a side perspective view of the swing barrier guide of FIG. 3.
Figure 11:
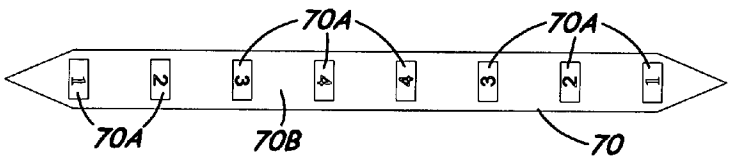
FIG. 11 is a top plan view of one of a plurality of markers of the swing instructional training guide of FIG. 9.
Figure 12:
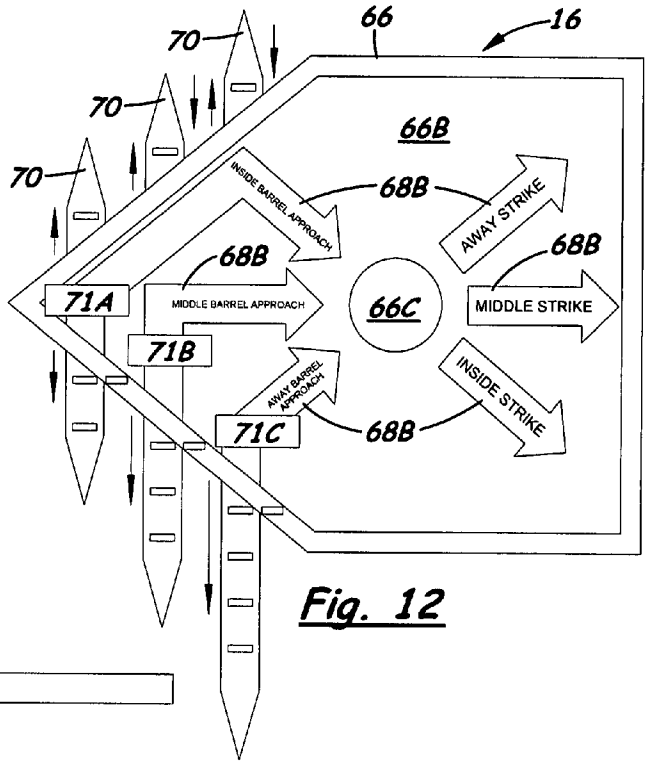
FIG. 12 is a top plan view of the swing instructional training guide of FIG. 9 after being turned over 180° about a longitudinal axis to orient the guide for use by a left-hand batter.
Figure 13:
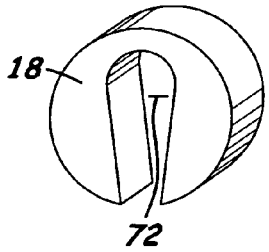
FIG. 13 is an enlarged top perspective view of the deformable interface or insert wedge of FIG. 3.
Figure 14:
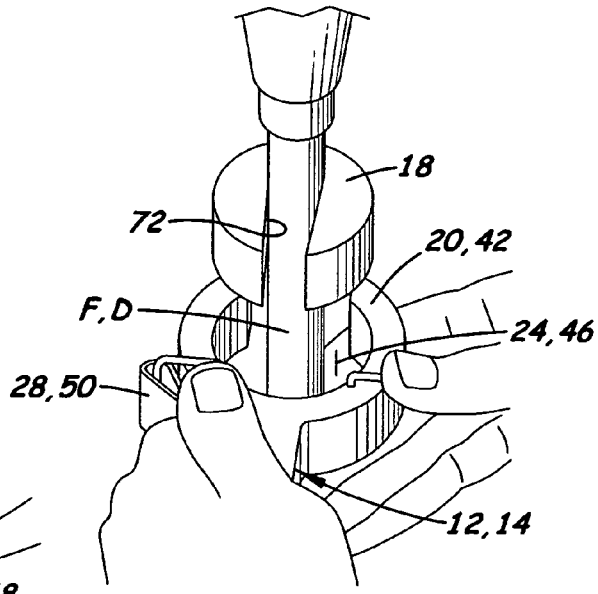
FIGS. 14-17 illustrate a sequence of stages in fitting the deformable interface or insert wedge of FIG. 13 into an opening of a clip-on portion of either the swing plane guide or swing barrier guide of the batting training system so as to enable the respective guide to be mounted on batting tee columns of different diameters.
Figure 15:
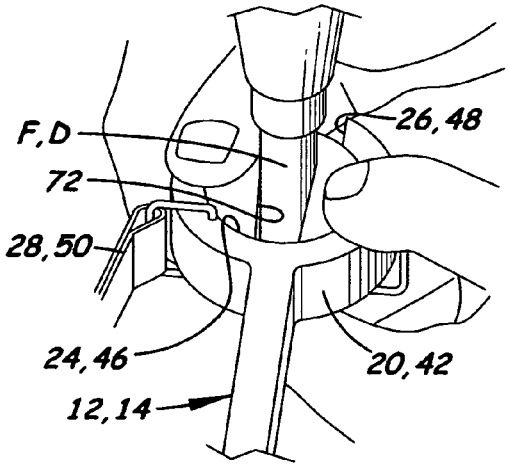
Figure 16:
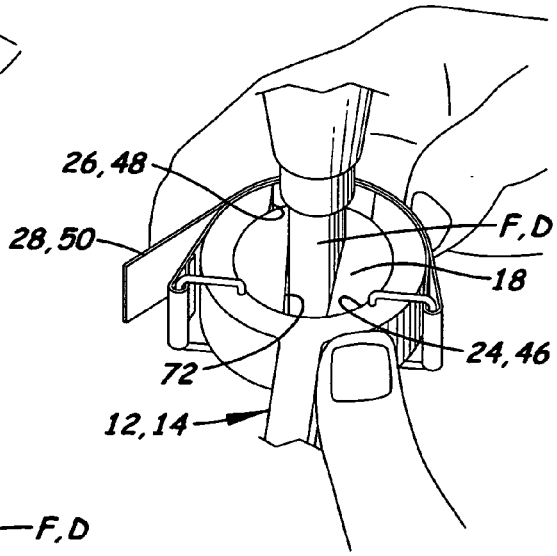
Figure 17:
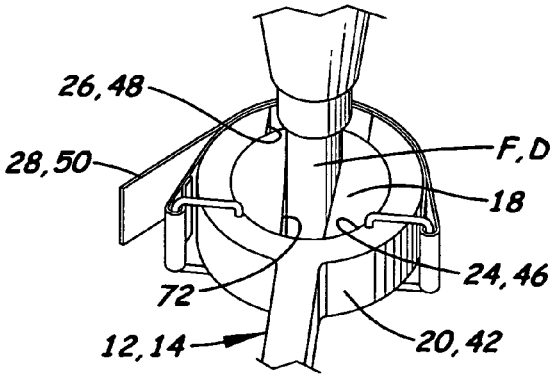

Turning now to FIGS. 13-17, there is shown in FIGS. 14-17 a sequence of stages in fitting the deformable interface or insert wedge 18, shown in FIGS. 3 and 13, into the opening 24 or 46 of the clip-on portion 20 or 42 of the corresponding swing plane guide 12 or swing barrier guide 14 so as to enable the respective guide 12 or 14 to be mounted on batting tee columns D of different diameters. The insert wedge 18 has a U-shaped configuration, as best seen in FIG. 13, which a side-opening central cavity 72 which allows it to first be applied about the upper end portion F of the batting tee column D, as shown in FIG. 14 and the clip-on portion 20 or 42 to be installed about the upper end portion F and below and aligned with the insert wedge 18. Next, as shown in FIG. 15, the insert wedge 18 is pushed into the opening 24 or 46 of the clip-on portion 20 or 42. Then, the strap 28 or 50 is fastened to itself, as shown in FIGS. 16 and 17.

Figure 18:
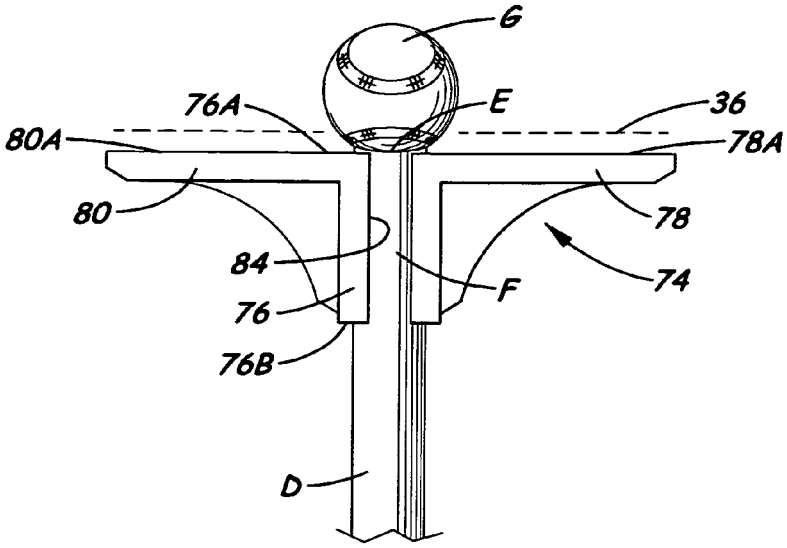
FIG. 18 is a side elevational view of another exemplary embodiment of a swing plane guide of the batting training system in accordance with the present invention shown applied to the upper end portion of the batting tee column.
Figure 19:
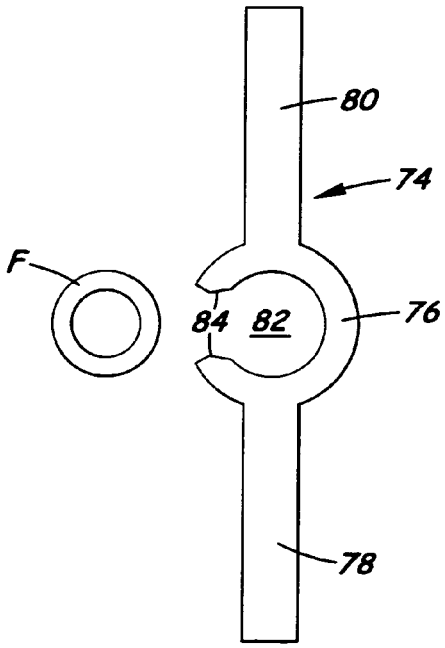
FIG. 19 is a top plan view of the swing plane guide of FIG. 18 before installation on the batting tee column.
Figure 20:
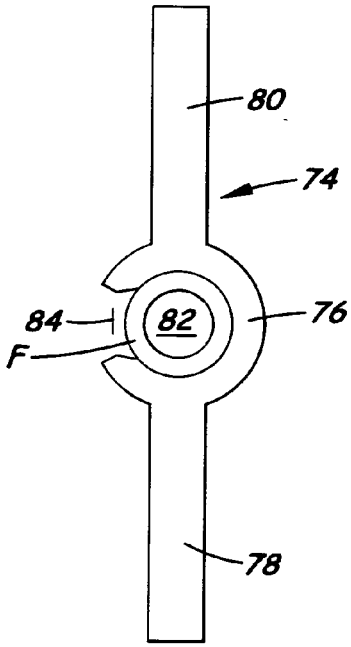
FIG. 20 is a top plan view of the swing plane guide of FIG. 18 after installation on the batting tee column.

Referring now to FIGS. 18-20, there is shown another exemplary embodiment of a swing plane guide 74 of the batting training system in accordance with the present invention. The swing plane guide 74, molded from a suitable material as discussed previously, includes an attachment or centrally-located clip-on portion 76 and a pair of beam structures 78, 80 integrally formed on and extending in opposite directions from the centrally-located clip-on portion 76. One of the beam structures 78, 80 constitutes a guide portion. Which one of the beam structures 78, 80 functions as the guide portion, as described heretofore, depends on the direction the hitter is swinging the bat. The other beam structure provides a means to use in conjunction with the one beam structure to actuate the guide 74 to effect its attachment to the upper end portion F of the batting tee column D. The clip-on portion 76 is a tubular-shaped body having a central opening 82 extending lengthwise between the opposite ends 76A, 76B of the clip-on portion 76 and a side slot 84 merging with the opening 82 that provides the body of the clip-on portion 76 with a C-shaped cross-sectional configuration. The clip-on portion 76 can be flexed sufficiently, by forcing the beam structures 78, 80 in a direction away from the side slot 84 and toward one another to cause bending of the swing plane guide 74 so as to expand the size of the side slot 84 so that the swing plane guide 74 can be inserted about the upper end portion F of the batting tee column D. The position of the swing plane guide 74 can be vertically adjusted by sliding it on the batting tee column D in order to place it at a short distance spaced below the ball G. The beam structures 78, 80 are then released which causes the clip-on portion 76 of the swing plane guide 74 to grip onto the upper end portion F of the batting tee column D. The top surfaces 78A, 80A of the beam structures 78, 80 are generally co-planar with respect to one another such that at least the top surface 78A, 80A of the one of the beam structures 78, 80 serving as the guide portion of the swing plane guide 74 provides the guide for the hitter to swing the bat along the desired swing plane that runs substantially parallel with and is disposed above the one top surface 78A, 80A. Additionally or alternately, the swing plane guide 74 can be attached onto the batting tee column D in any other suitable manner, such as by being fastened by clasp-type or hook-and-loop connectors on straps, releasable adhesive surfaces and the like.

Figure 21:
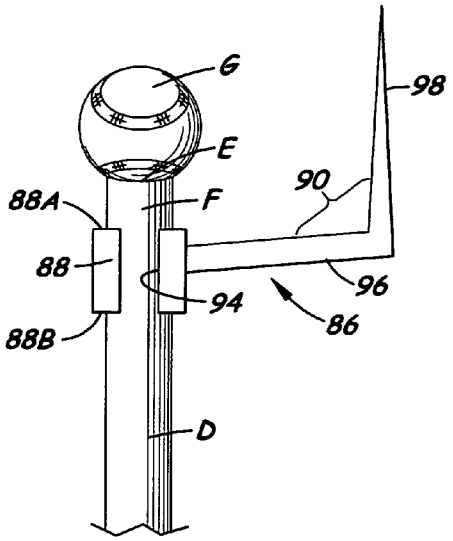
FIG. 21 is a side elevational view of another exemplary embodiment of a swing barrier guide of the batting training system in accordance with the present invention shown applied to the upper end portion of the batting tee column.
Figure 22:
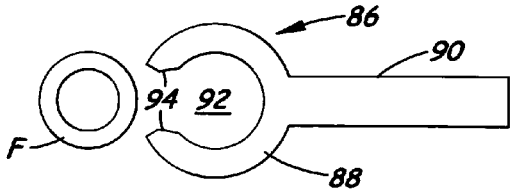
FIG. 22 is a top plan view of the swing barrier guide of FIG. 21 before installation on the batting tee column.

Referring now to FIGS. 21 and 22, there is shown another exemplary embodiment of a swing barrier guide 86 of the batting training system in accordance with the present invention for use with the swing plane guide 74 of FIGS. 18-20. The swing barrier guide 86, molded from a suitable material as discussed previously, includes an attachment or centrally-located clip-on portion 88 and barrier portion 90 integrally formed on and extending laterally therefrom. The clip-on portion 88 is a body of a tubular configuration with a central opening 92 and a side slot 94 merging with the opening 92 and both extending lengthwise between opposite ends 88A, 88B of the clip-on portion 88 providing it with a C-shaped cross-sectional configuration. The barrier portion 90 is a rod structure have a substantially right-angle configuration, with a substantially horizontal arm 96 at its inner end integrally attached to the clip-on portion 88 and a substantially vertical arm 98 at its lower end integrally attached to an outer end of the horizontal arm 96. The material forming the clip-on portion 88 of the guide 86 may be flexed sufficiently to allow the clip-on portion 88 to be installed about the upper end portion F of the batting tee column D and then upon relaxing the clip-on portion 88 to grip onto the column D as shown in FIG. 21. The position of the swing barrier guide 86 can be vertically adjusted by sliding the guide 86 on the batting tee column D, such as downward so that it can be used in conjunction with the swing plane guide 74. The same alternative methods of attachment can be used with regard to the swing barrier guide 86 as mentioned above with regard to the swing plane guide 74.

Figure 23:
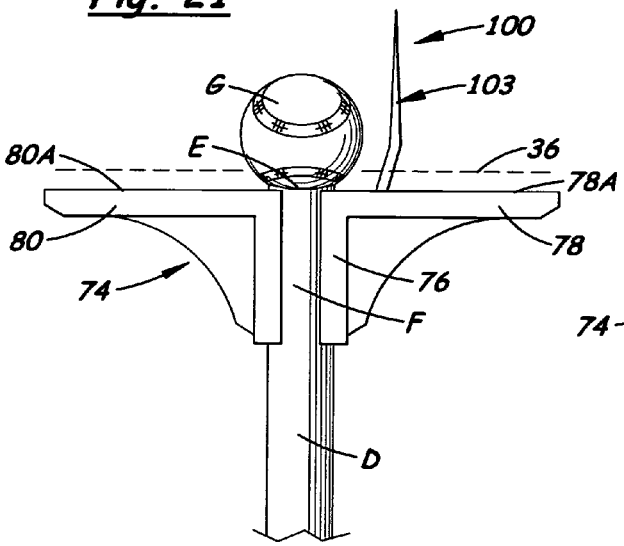
FIG. 23 is a side elevational view of another exemplary embodiment of a swing plane guide and a swing barrier guide of the batting training system in accordance with the present invention with the swing plane guide shown applied to the upper end portion of the batting tee column and the swing barrier guide supported on the swing plane guide.
Figure 24:
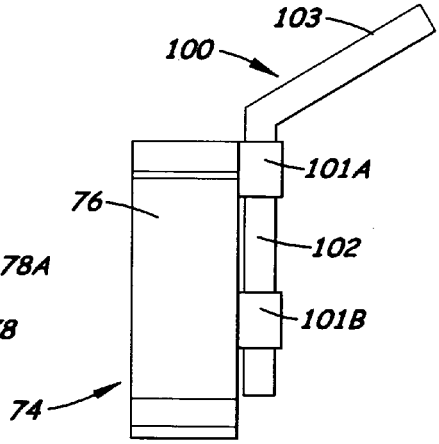
FIG. 24 is an end elevational view of the swing plane guide and swing barrier guide of FIG. 23.
Figure 25:
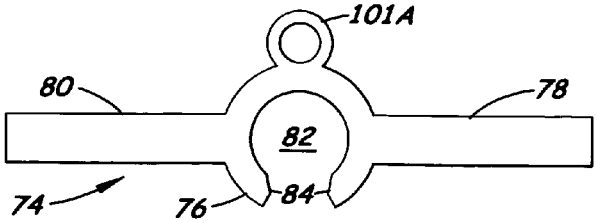
FIG. 25 is a top plan view of the swing plane guide of FIG. 23 before installation on the batting tee column and before installation of the swing barrier guide on the swing plane guide.
Figure 25:
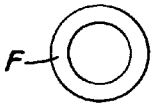

Referring to FIGS. 23-25, there is shown another exemplary embodiment a swing barrier guide 100 of the batting training system in accordance with the present invention. The swing barrier guide 100 is mounted directly to the swing plane guide 74 of FIGS. 18-20, instead of to the batting tee column D. Two rings 101A, 101B, which may be formed of the same material, are rigidly and integrally formed on the exterior surface of the clip-on portion 76 of the swing plane guide 74 at a location opposite from the side slot 84. The rings 101A, 101B are vertically spaced apart and aligned with one another. The guide 100 has a shaft portion 102, in place of the clip-on portion 88 of the previous swing barrier guide 86, which inserts from above into the two aligned rings 101A, 101B. The barrier portion 103 of the guide 100, which can be similar to that of the guide 86, is integrally formed on the upper end of the shaft portion 102 and extends laterally therefrom.

Figure 26:
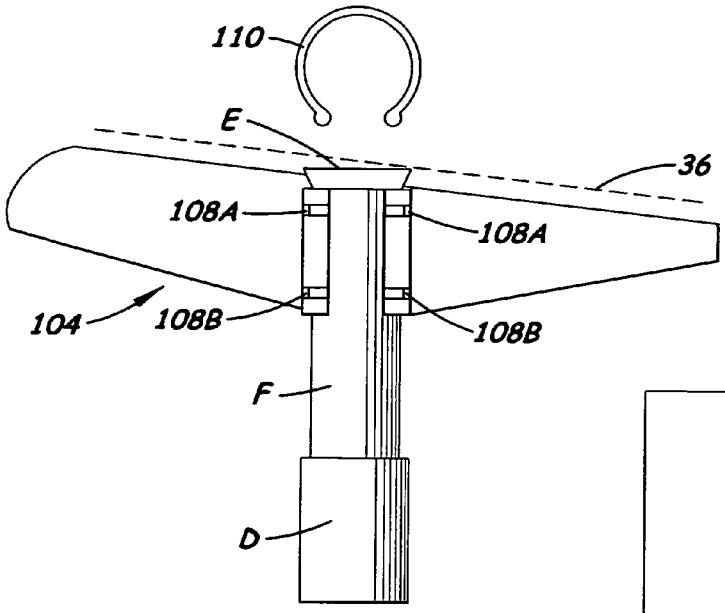
FIG. 26 is a side elevational view of another exemplary embodiment of a swing plane guide of the batting training system in accordance with the present invention with the swing plane guide shown applied to the upper end portion of the batting tee column.
Figure 27:
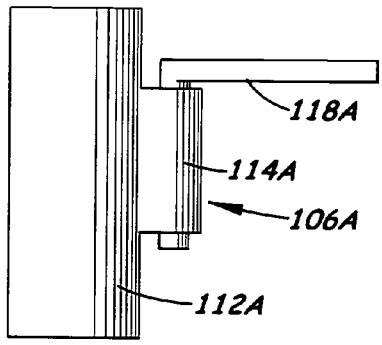
FIG. 27 is a side elevational view of another exemplary embodiment of a swing barrier guide of the batting training system in accordance with the present invention.
Figure 28:
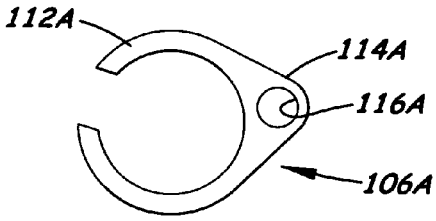
FIG. 28 is a top plan view of the swing barrier guide of FIG. 27.
Figure 29:
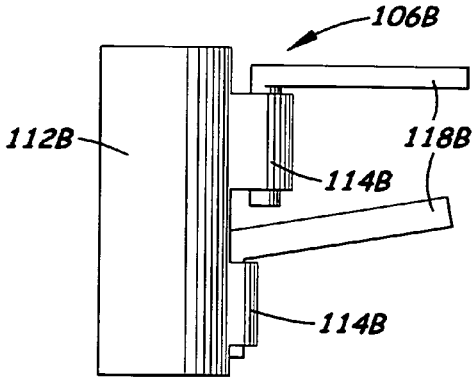
FIG. 29 is a side elevational view of another exemplary embodiment of a swing barrier guide of the batting training system.
Figure 30:
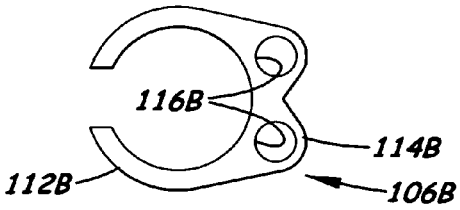
FIG. 30 is a top plan view of the swing barrier guide of FIG. 29.

Referring to FIGS. 26-30, there is shown another exemplary embodiment a swing plane guide 104 and alternative swing barrier guides 106A, 106B of the batting training system in accordance with the present invention. The guides 104, 106A and 106B are similar to those of FIGS. 23 and 24 except as follows. FIG. 26 shows that the swing plane guide 104 has a downward sloped or slanted top angle to help young players learn a down swing plane. Also the clip-on portion 108 of the guide 104 has upper and lower grooved slots 108A, 108B each adapted to receive a C-shaped clip 110 for attaching (or gripping) the guide 104 onto the upper end portion F of the batting tee column D. FIGS. 27-28 and 29-30 show that the alternative swing barrier guides 106A, 106B have respective molded receivers 112A, 112B being C-shaped and having respective flanges 114A, 114B with respective single and dual holes 116A, 116B for respectively mounting single and dual barrier portions 118A, 118B. The receivers 112A, 112B are C-shaped and deformable for installing them onto the upper end portion F of the batting tee column D. The 112A, 112B may be molded or incorporated into or used in conjunction with the clip-on portion 108 of the swing plane guide 104.

Figure 31:
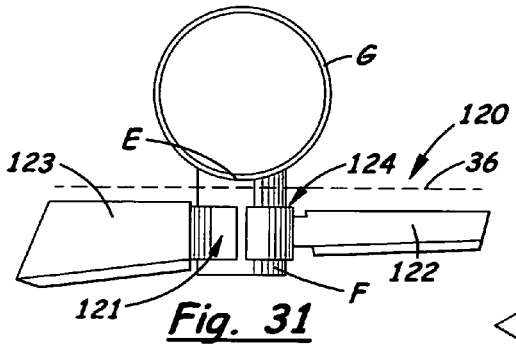
FIG. 31 is a side elevational view of another exemplary embodiment of a swing plane guide of the batting training system in accordance with the present invention with the swing plane guide shown applied to the upper end portion of the batting tee column.
Figure 32:
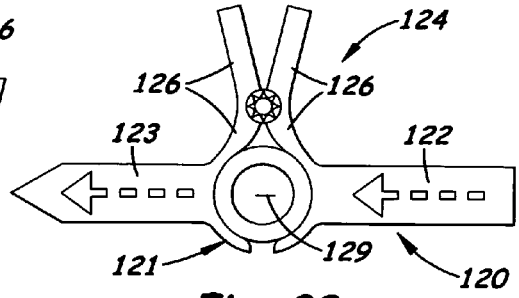
FIG. 32 is a top plan view of the swing barrier guide of FIG. 31.
Figure 33:
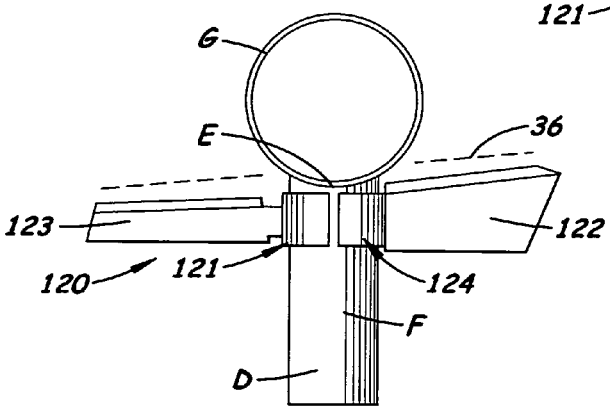
FIG. 33 is a side elevational view of the swing plane guide of FIG. 31 with the swing plane guide rotated 180°.

Referring to FIGS. 31-33, there is shown another exemplary embodiment of a swing plane guide 120 of the batting training system in accordance with the present invention. As seen in FIG. 31, the swing plane guide 120 has a clip-on portion 121 and opposite beam structures 122, 123, at least one of which constituting a guide portion providing the guide function as described heretofore. As seen in FIG. 32, the clip-on portion 121 now takes the form of a clamp mechanism 124 which includes a pair of clamp members 126 hinged together and a spring 128 disposed between them and biasing them to a closed clamping position, as seen in FIG. 32, in which the clamp members 126 define a central opening 129 (with a slot) receiving the upper end portion F of the batting tee column D, with the clamp members 126 clipped, gripping or clamped onto the batting tee column D. The clamp members 126 may be gripped and actuated by a user squeezing them by hand toward each other to retract them to an open release position (not shown) in order to allow the swing plane guide 120 to be installed onto or removed from the upper end portion F of the batting tee column D. The clamping mechanism 124 allows the swing plane guide 120 to be clamped to any size shaft such that the swing plane guide 120 is universal in that it will fit tees with large, medium and small diameter shafts. As seen in FIG. 33, the mounting relationship of the swing plane guide 120 on the batting tee column D can be inverted to change angle of the swing plane where the top surface of the swing plane guide now has a down slope plane.

Figure 34:
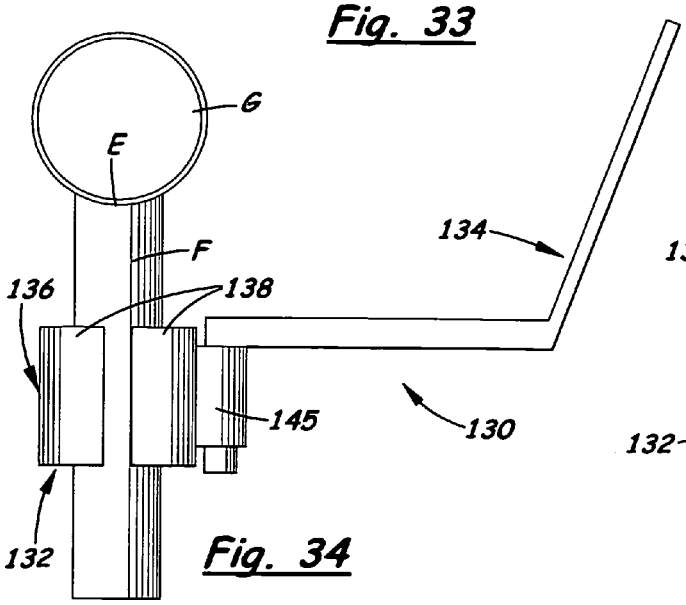
FIG. 34 is a side elevational view of another exemplary embodiment of a swing barrier guide of the batting training system in accordance with the present invention with the swing barrier guide shown applied to the upper end portion of the batting tee column.
Figure 35:
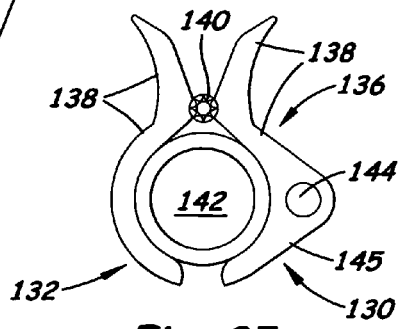
FIG. 35 is a top plan view of the swing barrier guide of FIG. 34.

Referring to FIGS. 34 and 35, there is shown another embodiment of a swing barrier guide 130 of the batting training system in accordance with the present invention. The swing barrier guide 130 has a clip-on portion 132 and a barrier portion 134. The clip-on portion 132 takes the form of a clamp mechanism 136 which includes a pair of clamp members 138 hinged together and a spring 140 disposed between them and biasing them to a closed clamping position, as seen in FIG. 34, in which the clamp members 138 define a central opening 142 (with a slot) receiving the upper end portion F of the batting tee column D, with the clamp members 138 clipped, gripping or clamped onto the batting tee column D. A user squeezes the clamp members 138 by hand to attach and detach the swing barrier guide 130 to and from the batting tee column D. The clamp mechanism 136 allows the swing barrier guide 130 to be clamped to any size shaft such that the swing barrier guide 130 is universal in that it will fit tees with large, medium and small diameter shafts. The barrier portion 134 is installed in a hole 144 in a flange 145 formed along one side portion of one of the clamp members 138 of the clamp mechanism 136 forming the clamp-on portion 132.

Figure 36:
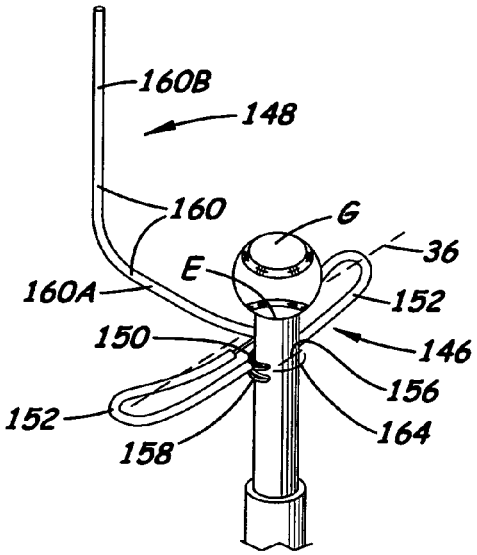
FIG. 36 is a top perspective view of another exemplary embodiment of a swing plane guide and a swing barrier guide of the batting training system in accordance with the present invention with the swing plane guide and swing barrier guide shown applied to the upper end portion of the batting tee column.
Figure 37:
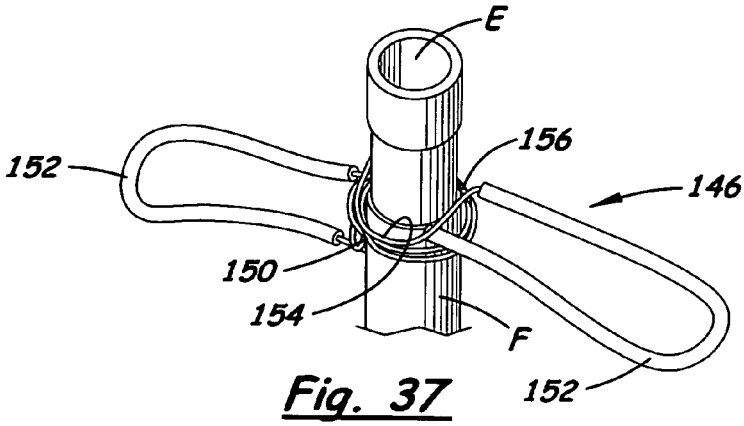
FIG. 37 is a top perspective view of the swing plane guide of FIG. 36.
Figure 38:
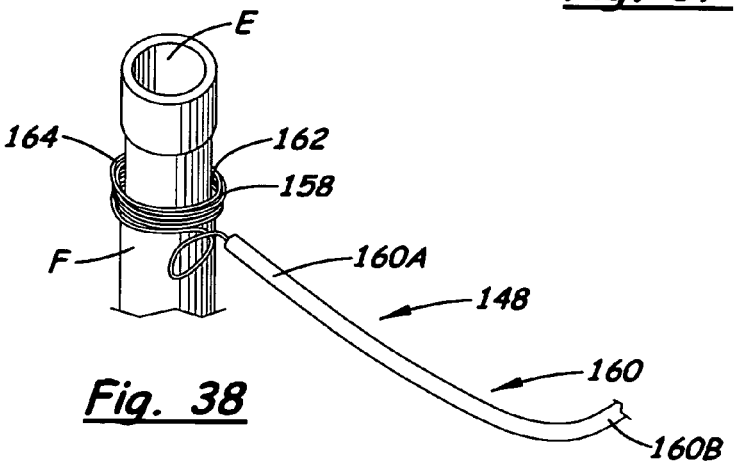
FIG. 38 is a top perspective view of the swing barrier guide of FIG. 36.

Referring now to FIGS. 36-38, there is shown another exemplary embodiment of a swing plane guide 146 and of a swing barrier guide 148 of the batting training system in accordance with the present invention. As seen in FIGS. 36 and 37, the swing plane guide 146 is made of bendable wire of a suitable plastic or metal material formed to provide an attachment or clip-on portion 150 and at least one and preferably a pair of wing structures 152 (one of which constituting a guide portion) and extending in opposite directions from the centrally-located clip-on portion 150. An outer flexible tubing of plastic or rubber material (not shown) may be inserted over the wire material forming each of the wing structures 152. The clip-on and guide portions 150, 152 perform the same functions as the corresponding components described above with respect to other exemplary embodiments. The clip-on portion 150 has a C-shaped configuration defining an opening 154 and side slot 156 merging with the opening 154 and its wire material is sufficiently flexible to allow it to be flexed enough to enlarge the opening 154 and allow insertion of the swing plane guide 146 about or its removal from the upper end portion F of the batting tee column D. Each wing structure 152 has a loop configuration.

Also, as best seen in FIG. 38, the swing barrier guide 148 is made of bendable wire of a suitable plastic or metal material formed to provide a clip-on portion 158 and a barrier portion 160 integrally formed on and extending laterally therefrom. An outer flexible tubing of plastic or rubber material (not shown) may be inserted over the wire material forming the barrier portion 160. The clip-on and barrier portions 158, 160 perform the same functions as the corresponding components described above with respect to the other exemplary embodiments. The clip-on portion 158 has a C-shaped configuration defining an opening 162 with a side slot 164 merging with the opening 162 and its wire material is sufficiently flexible to allow it to be flexed enough to enlarge the opening 162 and allow insertion of the swing barrier guide 148 about or its removal from the upper end portion F of the batting tee column D. The barrier portion 160 may have a substantially right-angle configuration, with a substantially horizontal arm 160A at its inner end integrally attached to the clip-on portion 158 and a substantially vertical arm 160B at its lower end integrally attached to an outer end of the horizontal arm 160A.

As mentioned previously, the various embodiments of the present invention may be made of rubber, plastic and/or metal material, wire or the like or combinations thereof. The sizes, lengths, and angles of the components may be varied from the ones illustrated herein. The materials may be those that allow the guides to be strong yet light enough to be supported by the stem or shaft of the tee. These guides are used in conjunction with any conventional batting tee, including three-position and five-position batting tees.

Some of the advantages of these exemplary embodiments of the guides of the system of the present invention are the following:

1. A batting training system that provides the batter with instruction at three points during the swing process: (a) pre-swing visual reference, meaning the batter is able to see what plane or path a good swing takes and also shows the batter what angle the bat barrel should take to the ball on each of three pitch locations, inside, middle and away; (b) mid-swing guidance, meaning during the swing the batter will have guides that act as visual reference to execute the proper swing; and (c) post-swing feedback, meaning after the swing the batter can assess his/her swing quality by realizing if the bat stayed within the guides or if the bat got outside the correct path and contacted one of the guides or barriers.

2. The guides can be attached to any conventional standard batting tee.

3. The guides convert a standard batting tee into an advanced skills batting trainer.

4. The guides can be used together or individually as to the needs of the user.

5. The guides are low in cost yet provide the same advanced swing training as components costing much more.

6. The swing plane guide will assist in training a batter to swing in a manner that prevents as well as corrects bad hitting flaws such as dipping on the back side or pulling the front shoulder out.

7. The swing barrier guide acts as a barrier to assist in training a batter to prevent as well as correct a swing that is too long. The guide assists in training a batter to avoid a common batting flaw known as casting.

8. The swing barrier guide can easily be rotated to a desired location relative to the swing plane guide and batting tee that provides a backside or outside swing barrier to force the user to have a compact swing that is short and quick to the ball.

9. The swing plane guide, in addition or supplement to the swing instructional hitting guide, may have directional arrow(s) so that when the swing plane guide is rotated to various positions, it provides the batter with a guide to show the exact desired angle from which the bat should approach and contact the ball when hitting the inside, middle and away strike locations.

10. When the tee height is raised or lowered, the attached guides can remain in place and do not have to be moved.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A batting training system, comprising:

a batting tee column having an upper end portion and a ball holder element on a top end of said upper end portion; and a swing plane guide having a clip-on portion detachably attached to said upper end portion of said batting tee column adjacent to and below said ball holder element, and a guide portion connected to and extending away from said clip-on portion, said guide portion having a top side extending linearly outward away from said clip-on portion such that said top side provides a guide for a hitter to follow for training to swing a bat along a swing plane running toward a ball on said ball holder element and substantially parallel to and above said top side of said guide portion of said swing plane guide to enable the hitter to make desired contact of the bat with a ball on the ball holder element.

2. The system of claim 1 wherein said clip-on portion of said swing plane guide has an opening receiving the upper end portion of said batting tee column, said clip-on portion gripping said upper end portion of said batting tee column.

3. The system of claim 2 wherein said clip-on portion of said swing plane guide has a slot merging with said opening and extending lengthwise between opposite ends of said clip-on portion of said swing plane guide, and a strap is coupled to said clip-on portion of said swing plane guide on opposite sides of said slot and having fastening elements adapting said strap to be placed across said slot and with said strap secured to itself so as to augment the attachment of said clip-on portion of said swing plane guide to said upper end portion of said batting tee column.

4. The system of claim 2 further comprising:

a resiliently deformable interface wedge having an U-shaped configuration defining a side-opening cavity adapting said wedge to fit on and about said upper end portion of said batting tee column from a side thereof and within said opening of said clip-on portion of said swing plane guide so as to enable said swing plane guide to be mounted on upper end portions of batting tee columns of different diameters.

5. The system of claim 1 wherein said guide portion takes the form of at least one of two wing structures which are connected on said clip-on portion and extend in opposite directions therefrom.

6. The system of claim 1 wherein said guide portion of said swing plane guide is pivotally connected to said clip-on portion of said swing plane guide to enable changing the inclination of said top side of said guide portion relative to said clip-on portion and thereby change the inclination of the swing plane relative to said ball holder element.

7. The system of claim 1 wherein said clip-on portion includes a clamp mechanism having clamp members that detachably attach said clip-on portion on said upper end portion of said batting tee column, said guide portion being connected to at least one of said clamp members.

8. A batting training system, comprising:

a batting tee column having an upper end portion and a ball holder element on a top end of said upper end portion;

a swing plane guide having a clip-on portion detachably attached to said upper end portion of said batting tee column adjacent to and below said ball holder element, and a guide portion connected to and extending away from said clip-on portion, said guide portion having a top side extending linearly outward away from said clip-on portion such that said top side provides a guide for a hitter to follow for training to swing a bat along a swing plane running toward a ball on said ball holder element and substantially parallel to and above said top side of said guide portion of said swing plane guide to enable the hitter to make desired contact of the bat with the ball on said ball holder element; and a swing barrier guide detachably attached to one of said clip-on portion of said swing plane guide or said upper end portion of said batting tee column at a location adjacent to and below said clip-on portion of said swing plane guide, said swing barrier guide having a barrier element displaced outwardly from and extending above said guide portion of said swing plane guide and said ball holder element to provide another guide for the hitter to follow for training to swing the bat along said swing plane and between the hitter and said barrier element without contacting said barrier element.

9. The system of claim 8 wherein said swing barrier guide includes:

a clip-on portion detachably attached to said upper end portion of the batting tee column adjacent to and below said clip-on portion of said swing plane guide; and a barrier portion connected to and extending away from said clip-on portion of said swing barrier guide, said barrier portion including said barrier element.

10. The system of claim 9 wherein said clip-on portion of said swing barrier guide has an opening receiving said upper end portion of batting tee column, said clip-on portion of said swing barrier guide gripping said upper end portion of said batting tee column.

11. The system of claim 10 wherein said clip-on portion of said swing barrier guide has a slot merging with said opening of said swing barrier guide and extending lengthwise between opposite ends of said clip-on portion of said swing barrier guide, and a strap is coupled to said clip-on portion of said swing barrier guide on opposite sides of said slot and having fastening elements adapting said strap to be place across said slot with said strap secured to itself so as to augment the attachment of said clip-on portion of said swing barrier guide to said upper end portion of said batting tee column.

12. The system of claim 10 further comprising:

a resiliently deformable interface wedge having an U-shaped configuration defining a side-opening cavity adapting said wedge to fit on and about said upper end portion of said batting tee column from a side thereof and within said opening of said clip-on portion of said swing barrier guide so as to enable said swing barrier guide to be mounted on upper end portions of batting tee columns of different diameters.

13. The system of claim 8 wherein said barrier portion of said swing barrier guide includes:

an outwardly-extending first arm connected at an inner end to said clip-on portion of said swing plane guide; and an upwardly-extending second arm connected at a lower end to an outer end of said first arm that defines said barrier element for the hitter.

14. The system of claim 9 wherein said barrier portion of said swing barrier guide includes:

an outwardly-extending first arm connected at an inner end to said clip-on portion of said swing barrier guide; and an upwardly-extending second arm connected at a lower end to an outer end of said first arm, said second arm defining said barrier element for the hitter, said first arm having inner and outer arm portions pivotally connected to one another to enable changing the position of said second arm and thereby said barrier element relative to the hitter.

15. The system of claim 8 further comprising:

a swing instructional training guide including a matt having a top surface and an opening through said matt adapting said matt to be installed over the batting tee column with the column extending through the matt and the matt overlying a support base of the batting tee column; and a series of indicators applied on said top surface of said matt representing middle, inside and away strike pitches relative to the batting tee column to show at what angle to locate the swing plane guide on the batting tee column relative to the strike zone of the hitter so as to identify for the hitter the correct path along which the hitter should swing the bat for approaching the ball to enable the hitter to make desired contact of the bat with the ball when the ball represents a pitch at one of the middle, inside or away strike locations.

16. The system of claim 15 wherein said swing instructional training guide further includes a series of markers connected to said matt and adapted to be adjustably moved relative to the matt, said markers having distinguishing markings on upper surfaces thereof so as to guide adjustment of said markers to different locations for feet placement by the hitter relative to said pitch location indicators.

17. The system of claim 1 further comprising:

a swing instructional training guide including a matt having a top surface and an opening through said matt adapting said matt to be installed over the batting tee column with the column extending through the matt and the matt overlying a base of the batting tee column; and a series of indicators applied on said top surface of said matt representing middle, inside and away strike pitches relative to the batting tee column to show at what angle to locate the swing plane guide on the batting tee column relative to the strike zone of the hitter so as to identify for the hitter the correct path along which the hitter should swing the bat for approaching the ball to enable the hitter to make desired contact of the bat with the ball when the ball represents a pitch at one of the middle, inside or away strike locations.

18. The system of claim 17 wherein said swing instructional training guide further includes a series of markers connected to said matt and adapted to be adjustably moved relative to the matt, said markers having distinguishing markings on upper surfaces thereof so as to guide adjustment of said markers to different locations for feet placement by the hitter relative to said pitch location indicators.

19. A batting training system, comprising:

a batting tee column having an upper end portion and a ball holder element on a top end of said upper end portion; and a swing plane guide having a clip-on portion detachably attached to the upper end portion of said batting tee column adjacent to and below said ball holder element, and a guide portion connected to and extending away from said clip-on portion of said swing plane guide so as to provide a guide for a hitter to follow for training to swing a bat along a swing plane running toward a ball on said ball holder element and substantially parallel to and above said top side of said guide portion of said swing plane guide to enable the hitter to make desired contact of the bat with a ball on the ball holder element; and a swing barrier guide having a clip-on portion detachably attached to the upper end portion of the batting tee column at a location adjacent to and below said clip-on portion of said swing plane guide, and a barrier portion connected to and extending away from said clip-on portion of said swing barrier guide, said barrier portion having an outwardly-extending first arm connected at an inner end to said clip-on portion of said swing barrier guide, and an upwardly-extending second arm connected at a lower end to an outer end of said first arm and extending above said guide portion of said swing plane guide and said ball holder element so as to define a barrier element that provides another guide for the hitter to follow for training to swing the bat along said swing plane and between the hitter and said barrier element without contacting said barrier element, wherein said first arm of said barrier portion has inner and outer arm portions pivotally connected to one another to enable changing the position of said second arm and thereby said barrier element relative to the hitter.

* * * * *